US007458137B2

(12) United States Patent
Wray et al.

(10) Patent No.: US 7,458,137 B2
(45) Date of Patent: Dec. 2, 2008

(54) CASKET HAVING MEMORABILIA COMPARTMENT

(75) Inventors: Greg Wray, Guilford, IN (US); Jamie D. Riddle, Sunman, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 11/837,884

(22) Filed: Aug. 13, 2007

(65) Prior Publication Data

US 2007/0271748 A1 Nov. 29, 2007

Related U.S. Application Data

(62) Division of application No. 10/803,828, filed on Mar. 18, 2004, now Pat. No. 7,254,875.

(51) Int. Cl.
*A61G 17/00* (2006.01)

(52) U.S. Cl. ..... 27/19; 40/725

(58) Field of Classification Search ..... 27/19, 27/2, 1, 14; 40/725, 771, 776; 206/566; D99/8, 10; 5/482, 485
See application file for complete search history.

(56) References Cited

U.S. PATENT DOCUMENTS 4,311,235 A * 1/1982 Titus ..... 206/483
4,312,104 A * 1/1982 Baker et al. ..... 27/19
4,401,219 A * 8/1983 Mink ..... 206/566
5,495,648 A * 3/1996 Rojdev et al. ..... 27/19
5,533,241 A * 7/1996 McConnell ..... 27/27
5,611,124 A * 3/1997 Biondo et al. ..... 27/2
5,675,876 A * 10/1997 Benedict et al. ..... 27/2
D390,319 S * 2/1998 Benedict et al. ..... D99/8
5,727,291 A * 3/1998 Biondo et al. ..... 27/2
5,784,768 A * 7/1998 Rojdev ..... 27/19
5,813,099 A * 9/1998 Stewart ..... 27/2
D405,582 S * 2/1999 Benedict et al. ..... D99/8
5,898,962 A * 5/1999 McNeal ..... 5/639
6,324,736 B1 * 12/2001 Atrio ..... 27/2
6,684,422 B2 * 2/2004 LeFevre et al. ..... 5/496
6,735,831 B1 * 5/2004 Greiwe et al. ..... 27/1
2004/0040130 A1 * 3/2004 Teague ..... 27/19

* cited by examiner

*Primary Examiner*—William L. Miller
(74) *Attorney, Agent, or Firm*—Wood, Herron & Evans, L.L.P.

(57) ABSTRACT

A casket memorabilia compartment assembly adapted to couple to a casket to provide display and/or storage of pictures memorializing the deceased. The memorabilia compartment assembly comprises a panel mountable to the casket for swinging displacement between an inner hanging position within the casket and an outer hanging without the casket. The panel includes a display side exposed when in the outer hanging position. The display side includes a compartment for the display and/or storage of pictures. The outer surface of the compartment is transparent so as to view the pictures within the compartment. The memorabilia compartment assembly can be incorporated into a big body and/or throw used during viewing of the deceased.

4 Claims, 4 Drawing Sheets

CASKET HAVING MEMORABILIA COMPARTMENT

RELATED APPLICATION

This application is a divisional of U. S. application Ser. No. 10/803,828 filed Mar. 18, 2004, now U.S. Pat. No. 7,254,875, which is hereby incorporated by reference.

FIELD OF THE INVENTION

This invention relates generally to caskets, and more particularly to caskets with compartments for containing memorabilia relating to the deceased.

BACKGROUND OF THE INVENTION

There is a trend in the death care industry to make efforts towards "personalizing" the funeral products and the funeral or other services purchased for the deceased to provide a more meaningful burial service experience for the family and friends of the deceased. Oftentimes, there is a desire on the part of the deceased's family and loved ones to memorialize the faithfully departed. This may manifest itself in several ways such as, for example, displaying various religious or sentimental items close to or on the casket during viewing of the deceased or even placing items in the casket prior to interment of the casket into the ground. The display and/or storage of various items of personalty near or in caskets has existed as a means to memorialize the deceased.

One of the earlier attempts at providing a means of personalizing or customizing a casket to the deceased may be seen with reference to the assignee's U.S. Pat. No. 4,457,054 titled Casket Shelf. That patent discloses a casket shelf which is mounted to the dish assembly of the head end cap when the head end cap is in the open position, such as during viewing of the deceased. The shelf provides a surface for supporting and displaying articles of religious or personal significance to the deceased. Additionally, the assignee's pending U.S. patent application Ser. No. 09/788,769 filed on Feb. 20, 2001 and titled Memorialization Casket discloses an alcove structure having a recess for mounting and displaying an ornament as a means of memorializing the deceased.

Furthermore, many current caskets do not provide any designated, easily accessibly receptacle or compartment for either the display of personal effects of the deceased therein or the inclusion therein of mementos of memorialization by the deceased's family and friends. Prior attempts at solving this shortcoming have generally taken the form of the placement of a small memento box into the casket alongside the deceased. However, such memento boxes often appear as an afterthought, simply placed alongside the deceased in the casket somewhat haphazardly. A casket having a memorabilia compartment integral to the casket for storing mementos and other items of memorabilia may be seen with reference to the assignee's U.S. Pat. No. 5,611,124 titled Casket Having Memorabilia Compartment. Caskets having a memorabilia compartment or drawer in which keepsakes of the deceased can be stored and displayed are commercially available as the MemorySafe® line of caskets available from Batesville®.

Advances have therefore been made in the area of "personalization" of funeral products by displaying and storing memorabilia, as demonstrated by the patents and products discussed above. However, there continues to be room for improvement in the area of providing caskets with memorabilia display and storage.

SUMMARY OF THE INVENTION

The present invention is a memorabilia compartment assembly adapted to couple to a casket for displaying and/or storing pictures memorializing the deceased. The memorabilia compartment assembly comprises a panel mountable to the casket for swinging displacement between an inner hanging position within the casket and an outer hanging position without the casket. The panel has a display side exposed when the panel is in the outer hanging position. The display side of the panel includes a compartment for retaining the pictures and includes a transparent outer surface for displaying the pictures within the compartment.

The compartment can comprise a plurality of pockets each having an opening for inserting the picture in the pocket. The display side of the panel can have an ornamental appearance. The panel can be mounted to the shell of the casket.

In another embodiment of the invention, a big body is adapted to couple to a casket for displaying and/or storing pictures memorializing the deceased. The big body comprises a decorative fabric panel adapted to be mounted to the casket for swinging displacement between an inner hanging position within the casket and an outer hanging position without the casket. The panel has a display side exposed when the panel is in the outer hanging position. The display side of the panel includes a compartment for retaining the pictures and includes a transparent outer surface for displaying the pictures within the compartment.

In yet another embodiment of the invention, a big body comprises first and second panels, each panel adapted to be mounted to the casket for swinging displacement between an inner hanging position within the casket and an outer hanging position without the casket. The first panel has an outer side exposed when the first panel is in the outer hanging position. The second panel has a display side exposed when the second panel is in the outer hanging position. The second panel overlies at least a portion of the first panel when both are in the outer hanging position. The outer side of the first panel includes decorative fabric. The display side of the second panel includes a compartment for retaining the pictures and includes a transparent outer surface for displaying the pictures within the compartment.

In still another embodiment of the invention, a throw is adapted to couple to a casket for displaying and/or storing pictures memorializing the deceased. The throw comprises a big body including a decorative fabric panel adapted to be mounted to the casket for swinging displacement between an inner hanging position within the casket and an outer hanging position without the casket. The panel has a display side exposed when the panel is in the outer hanging position. An overthrow including a decorative fabric panel is attached to the big body and is adapted to overlie at least a portion of a cap of the casket. The display side of the panel includes a compartment for retaining the pictures and includes a transparent outer surface for displaying the pictures within the compartment.

In still another embodiment of the invention, a throw comprises a big body having first and second panels, each panel adapted to be mounted to the casket for swinging displacement between an inner hanging position within the casket and an outer hanging position without the casket. The first panel has an outer side exposed when the first panel is in the outer hanging position. The second panel has a display side exposed when the second panel is in the outer hanging position. The second panel overlies at least a portion of the first panel when both are in the outer hanging position. The outer side of the first panel includes decorative fabric. An overthrow including a decorative fabric panel is attached to the big body and is adapted to overlie at least a portion of a cap of the casket. The display side of the second panel includes a compartment for retaining the pictures and includes a transparent outer surface for displaying the pictures within the compartment.

The present invention also provides a casket comprising a shell, a cap pivoted to the shell and a memorabilia compartment assembly, big body or throw of the above construction.

These and other features and advantages of the present invention will become more readily apparent during the following detailed description taken in conjunction with the drawings herein, in which:

BRIEF DESCRIPTION OF THE DRAWINGS OF THE INVENTION

DETAILED DESCRIPTION OF A PREFERRED EMBODIMENT OF THE INVENTION

Figure 1:
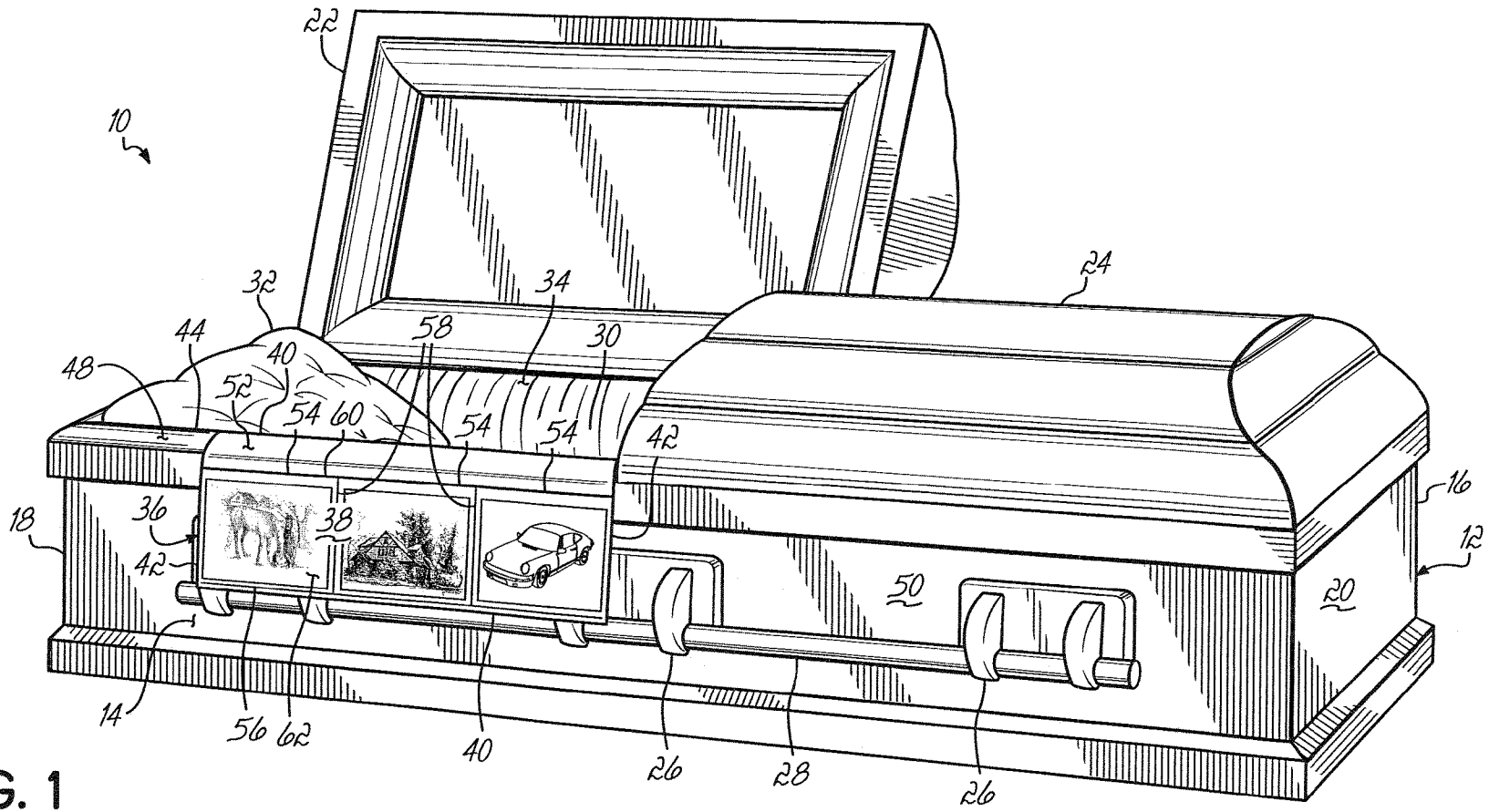
FIG. 1 is a perspective view of a casket including a memorabilia compartment assembly in the outer hanging position according to the principles of the present invention.

With reference to FIG. 1, there is illustrated a casket 10 constructed according to the principles of the present invention. Casket 10 includes a casket shell 12 having a pair of side walls 14, 16 and a pair of end walls 18, 20. Casket 10 further includes a pair of half or split caps 22 and 24 pivoted to the shell 12 by hinges or other means known to those skilled in the art. Arms 26 attach a handle bar 28 to the casket shell side walls 14, 16. As shown in FIG. 1, the cap 22 is open, which is common when displaying the casket 10 to customers or at an actual visitation service. With the cap 22 in the open position, a portion of the interior 30 is exposed, thus permitting decorative items such as pillow 32 and small body 34 to be viewed.

With continued reference to FIG. 1, the casket 10 further includes a memorabilia compartment assembly 36 for displaying and/or storing pictures, such as photographs or the like, relating to the deceased. The memorabilia compartment assembly 36 can comprise a generally rectangular panel 38 having a pair of opposing sides 40 and 42. One of the sides 40 of panel 38 can couple to casket shell 12 along an interior, upper portion 44 of side wall 14 that is exposed when cap 22 is in the open position. However, it should be realized that panel 38 can be coupled to casket 10 at other locations and so the claims are not limited to the location shown.

Figure 2:
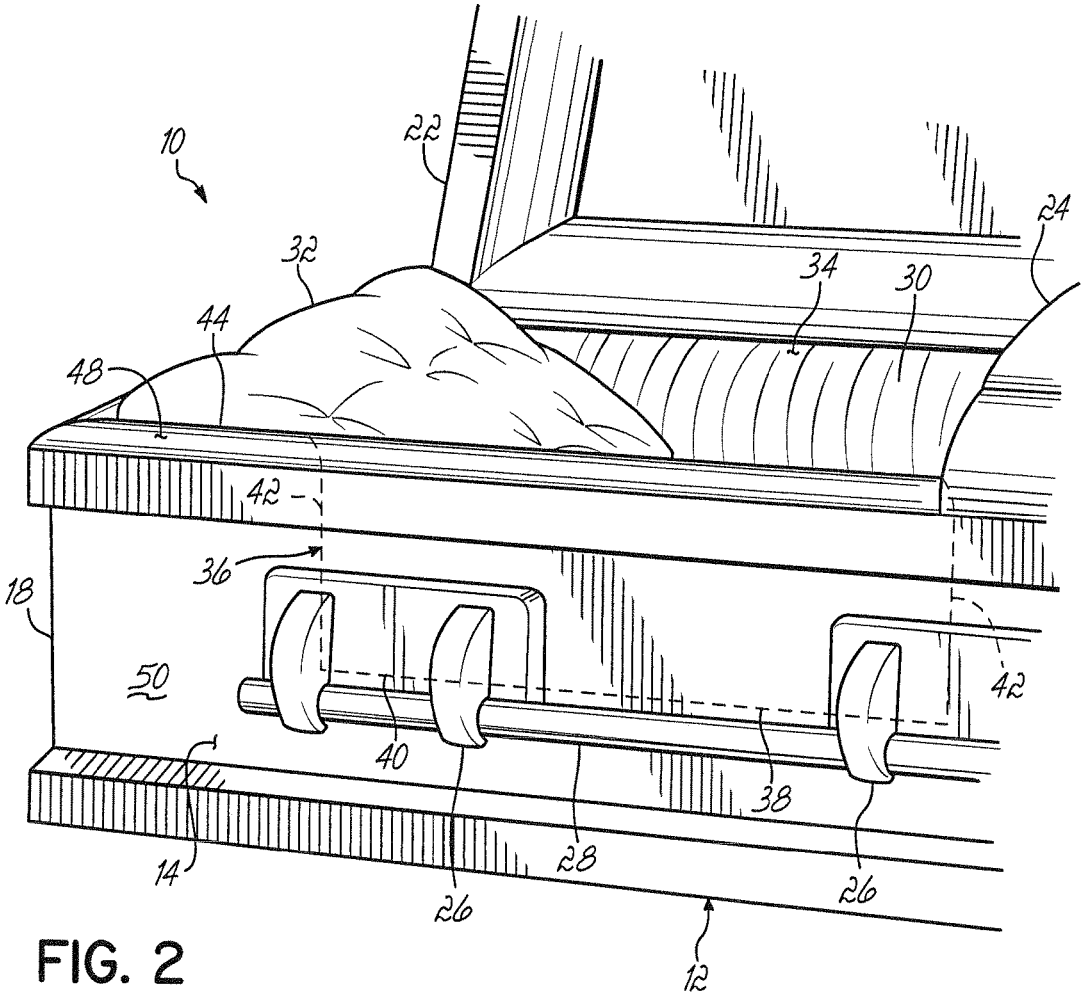
FIG. 2 is a partial perspective view of the casket of FIG. 1 with the memorabilia compartment assembly in the inner hanging position.

Panel 38 is pivotable about the side 40 that is coupled to shell 12 between an inner hanging position within the casket 10 and an outer hanging position without, or outside, the casket 10. As shown in FIG. 2, in which like reference numerals refer to like features in FIG. 1, when in the inner hanging position, panel 38 is contained within the interior 30 of casket 10. In this way, if the family of the deceased does not desire a memorabilia compartment to display or store various pictures, the memorabilia compartment assembly 36 can be positioned in the inner hanging position and essentially hidden from view. In the inner hanging position, panel 38 hangs downward, adjacent the interior of side wall 14. Moreover, the exposed inner side of panel 38 when in the inner hanging position can be decorated so as to match the color and/or decorative design of the interior 30 of casket 10 such that memorabilia compartment assembly 36 blends in with the interior decorative design of the casket 10.

On the occasion that the family of the deceased wishes to memorialize the deceased by providing a compartment for displaying and/or storing pictures, panel 38 can be pivoted or rotated about side 40 coupled to shell 12 to an outer hanging position. As shown in FIG. 1, when in the outer hanging position, panel 38 overlies the upper edge or rim 48 of side wall 14 and hangs downward overlying at least a portion of the outer surface 50 of side wall 14. When in the outer hanging position, panel 38 includes a display side 52 that is exposed on the exterior of casket 10. At least a portion of display side 52 of panel 38 includes one or more compartments 54 for displaying and/or storing pictures. As shown in FIG. 1, compartments 54 can be formed as one or more pockets being sealed along bottom edge 56 and vertical edges 58 and being open along top edge 60. Pictures, photographs, other pictoral items or the like can be placed in the pockets through openings along top edge 60. Additionally, the front or outer surface 62 of compartments 54 can be made from a transparent material so that the contents of the compartments 54 can be viewed. By way of example, and as shown in FIG. 1, pictures having special meaning to the deceased may be displayed in compartments 54.

Memorabilia compartment assembly 36 can be used for not only displaying pictures memorializing the deceased, but can also be used to store the pictures when the casket is interred in the ground. After viewing of the deceased, panel 38 can again be rotated about the side 40 coupled to casket shell 12 so as to be in the inner hanging position and completely contained within the interior 30 of casket 10. The pictures continue to be retained within compartments 54 when positioned back to the inner hanging position. With panel 38 in the inner hanging position, casket cap 22 can be closed and casket 10 prepared for interment into the ground.

Figure 3A:
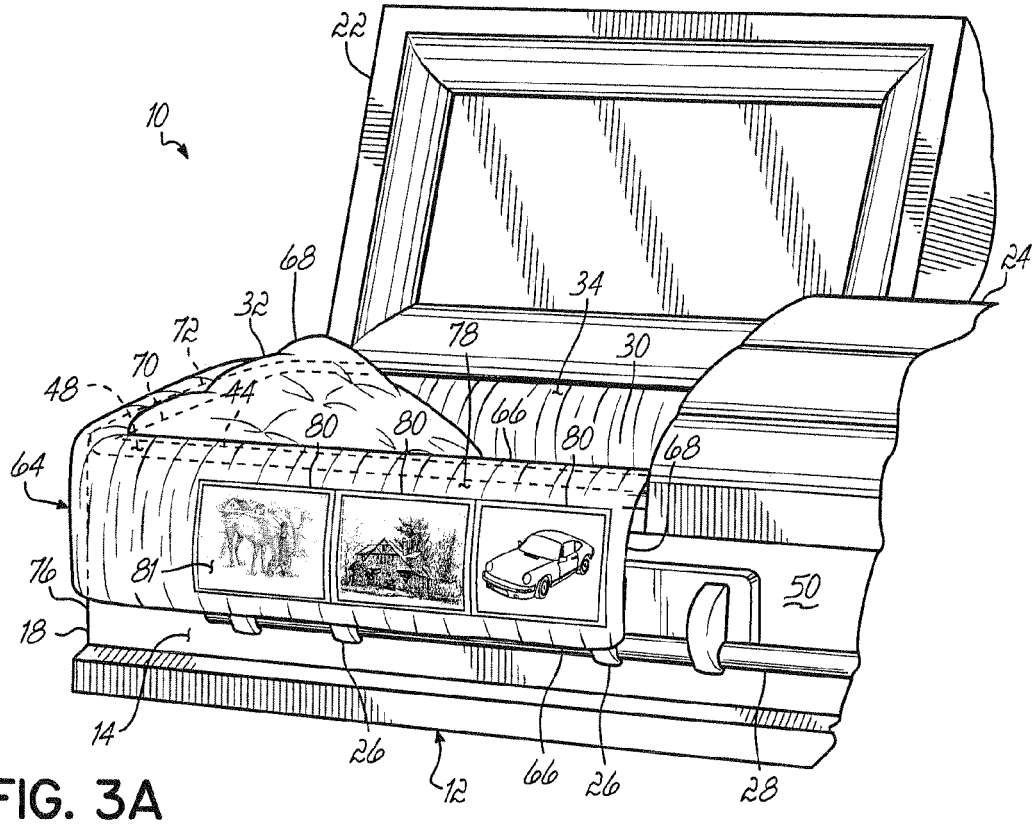
FIG. 3A is a partial perspective view of a casket including a big body having a memorabilia compartment integrally formed therewith.
Figure 3B:
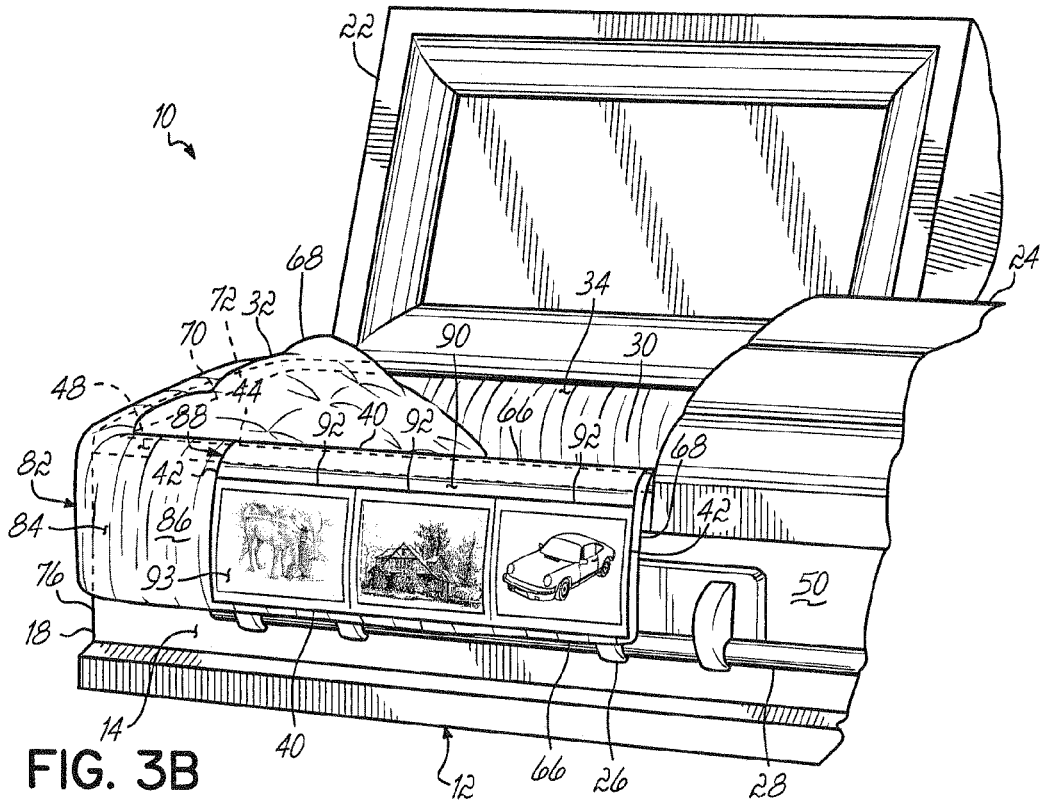
FIG. 3B is a partial perspective view of a casket including a big body having first and second panels, the second panel having a memorabilia compartment formed therewith.

Referring now to FIGS. 3A and 3B, in which like reference numerals refer to like features in FIG. 1, there are shown additional embodiments of the present invention. During the viewing of the deceased, it is often desirable to enhance the aesthetic appeal of the casket by providing a big body 64 along the exposed portions of side wall 14 and end wall 18 when cap 22 is open. The big body 64 comprises a generally L-shaped rectangular panel having a pair of opposing sides 66 and 68. One of the sides 66 of big body 64 is coupled to casket shell 12 along the interior, upper portion 44 of side wall 14 and interior, upper portion 70 of end wall 18. Big body 64 couples to shell 12 along the portion of the casket exposed when cap 22 is in the open position. Big body 64 is made from decorative fabric or other decorative materials known in the art.

Big body 64 is pivotable about the side 66 coupled to shell 12 between inner and outer hanging positions. When in the inner hanging position, big body 64 is contained within the interior 30 of casket 10 and essentially hidden from view. However, on the occasion that the family of the deceased wishes to memorialize the deceased by providing a compartment for displaying and/or storing pictures pertaining to the deceased, big body 64 can be pivoted or rotated about side 66 coupled to shell 12 to an outer hanging position. As shown in FIG. 3A, when in the outer hanging position, big body 64 overlies the upper edge or rim 48, 72 of side wall 14 and end wall 18 respectively and hangs downward overlying at least a portion of the outer surface 50, 76 of side wall 14 and end wall 18 respectively. When in the outer hanging position, big body 64 includes a display side 78 exposed on the exterior of casket 10 that is not only decorative but also includes one or more compartments 80 formed integral to big body 64 for displaying and/or storing pictures memorializing the deceased. The outer surface 81 of compartment 80 can be made from a transparent material so that the contents of compartment 80 can be viewed.

As shown in FIG. 3B, however, the compartments for displaying and/or storing pictures do not have to be formed integral to the big body 64. In another embodiment of the present invention, a big body 82 comprises a first panel 84 that can be described in the same fashion as big body 64 was described in FIG. 3A, except that the outer side 86 of first panel 84 does not include any compartments for storing pictures pertaining to deceased. Instead, big body 82 further comprises a second panel 88 that can be described in the same fashion as the memorabilia compartment assembly 36 was described in FIG. 1. When the first and second panels are both in the outer hanging position, the display side 90 of second panel 88 overlies at least a portion of outer side 86 of first panel 84. The display side 90 of second panel 88 includes one or more compartments 92 for displaying and/or storing pictures having some significance to the deceased. The outer surface 93 of compartment 92 can be made from a transparent material so that the contents of compartment 92 may be viewed.

Figure 4:
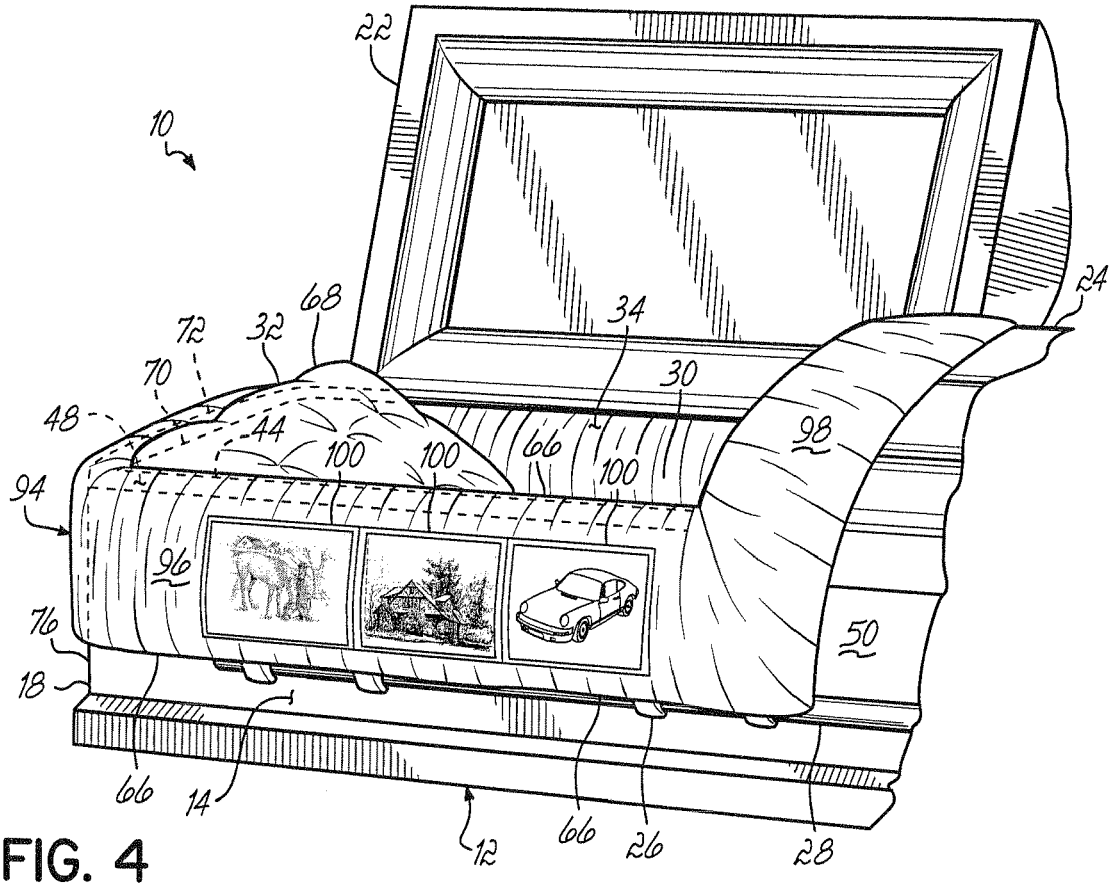
FIG. 4 is a partial perspective view of a casket including a throw having a big body with a memorabilia compartment integrally formed therewith.

Referring now to FIG. 4, in which like reference numerals refer to like features in FIG. 1, there is shown another embodiment of the present invention. To further enhance the aesthetic appeal of the casket during the viewing of the deceased, a throw 94 can be provided. Throw 94 includes a big body 96 and an overthrow 98 that overlies a portion of closed cap 24 from side wall 14 to side wall 16. In this way, the exposed edges of casket 10 are covered with decorative features when cap 22 is in the open position. This provides a warmer, more aesthetically pleasing viewing of the deceased. As shown in FIG. 4, the big body 96 of throw 94 can have compartments 100 for displaying and/or storing pictures integrally formed in big body 96 in a similar manner as that described for the big body 64 of FIG. 3A. It should also be realized, that although not shown in the figures, that big body 96 of throw 94 can comprise first and second panels such as that described for the big body 82 in FIG. 3B.

Those skilled in the art will readily recognize numerous adaptations and modifications which can be made to the present invention which will result in an improved casket having a memorabilia compartment, yet all of which will fall within the spirit and scope of the present invention as defined in the following claims. For example, the memorabilia compartment could be attached to the casket lid or cap, and could be deployed either with the cap in the open or closed position. Accordingly, the invention is to be limited only by the scope of the following claims and their equivalents.

What is claimed is:

1. A casket having a big body for displaying and/or storing pictures memorializing a deceased, said casket comprising:

a shell;

a cap pivoted to said shell; and said big body comprising:

a decorative fabric panel mounted to said shell for swinging displacement between an inner hanging position within said casket and an outer hanging position outside said casket, said panel having a display side exposed when said panel is in the outer hanging position;

said display side of said panel including a compartment for retaining the pictures, said compartment including a transparent outer surface for displaying the pictures in said compartment.

2. The casket of claim 1 wherein said compartment comprises a plurality of pockets each having an opening for inserting the picture in said pocket.

3. The casket of claim 1 wherein said decorative fabric panel is fabricated of a flaccid material.

4. The casket of claim 3 wherein said flaccid material is cloth.

* * * * *